US010365079B2

(12) United States Patent
Harrington et al.

(10) Patent No.: US 10,365,079 B2
(45) Date of Patent: Jul. 30, 2019

(54) IGNITER AND IGNITION DEVICE FOR DOWNHOLE SETTING TOOL POWER CHARGE

(71) Applicant: Baker Hughes, a GE company, LLC, Houston, TX (US)

(72) Inventors: Kevin Edgar Harrington, Houston, TX (US); Larry Palmer, Spring, TX (US); Zhiyue Xu, Cypress, TX (US); YingQing Xu, Tomball, TX (US); Lei Zhao, Houston, TX (US); Kent Meyer, Tomball, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

(21) Appl. No.: 15/800,323

(22) Filed: Nov. 1, 2017

(65) Prior Publication Data

US 2019/0128657 A1 May 2, 2019

(51) Int. Cl.

| | |
|---|---|
| ***F42D 1/22*** | (2006.01) |
| ***E21B 7/00*** | (2006.01) |
| ***F42D 1/045*** | (2006.01) |

(52) U.S. Cl.

CPC ..... *F42D 1/22* (2013.01); *E21B 7/007* (2013.01); *F42D 1/045* (2013.01)

(58) Field of Classification Search

CPC ..... F42D 1/045; F42D 1/22; E21B 7/007
USPC ..... 102/313; 166/63, 299
See application file for complete search history.

(56) References Cited

U.S. PATENT DOCUMENTS

| | | | | | |
|---|---|---|---|---|---|
| 5,146,983 | A * | 9/1992 | Hromas | E21B 23/04 | 166/120 |
| 5,316,087 | A * | 5/1994 | Manke | E21B 23/065 | 166/381 |
| 5,343,963 | A * | 9/1994 | Bouldin | E21B 23/00 | 166/65.1 |
| 5,347,929 | A * | 9/1994 | Lerche | E21B 43/1185 | 102/202.14 |
| 5,613,557 | A * | 3/1997 | Blount | E21B 23/06 | 166/277 |
| 6,164,375 | A * | 12/2000 | Carisella | E21B 23/04 | 166/373 |
| 7,565,927 | B2 * | 7/2009 | Gerez | E21B 43/116 | 166/250.01 |
| 2006/0249045 | A1 * | 11/2006 | Goodman | F42D 1/045 | 102/305 |

(Continued)

*Primary Examiner* — Bret Hayes
(74) *Attorney, Agent, or Firm* — Parsons Behle & Latimer

(57) ABSTRACT

A downhole setting tool having a first housing, a second housing having a chamber connected to the first housing, a power charge positioned within the chamber, an igniter connected to a portion of the power charge, and an ignition device connected to the igniter. The ignition device is configured to actuate upon receipt of an electrical signal. The ignition device is configured to ignite the igniter. The ignition device may rapidly heat up or apply a voltage or current to the igniter. The igniter is configured to cause the detonation of the power charge to set a device within a wellbore. The igniter may be embedded into the power charge with the ignition device positioned within a cavity in the igniter. The igniter may be a pyrotechnic material or may release high energy heat upon application of voltage or current.

22 Claims, 3 Drawing Sheets

(56) References Cited

U.S. PATENT DOCUMENTS

2009/0223400 A1* 9/2009 Hill ..... E21B 43/1185
102/202.7

* cited by examiner

IGNITER AND IGNITION DEVICE FOR DOWNHOLE SETTING TOOL POWER CHARGE

FIELD OF THE DISCLOSURE

The embodiments described herein relate to an igniter and ignition device for a power charge for downhole setting tools and methods of using the same.

BACKGROUND

Description of the Related Art

A downhole setting tool may use a power charge to set a device within a wellbore. The power charge is detonated to generate the force required to set the device. For example, the force from the detonated power charge may move a piston causing the setting of the device. The power charge of the downhole setting tool may be used to set various devices in a wellbore as would be appreciated by one of ordinary skill in the art. For example, a downhole setting tool with a power charge may be used to set bridge plugs, cement retainers, packers, and various other downhole devices.

An electrical signal is typically sent down a conduit to the setting tool to actuate a primary igniter in the firing head of the setting tool. The actuation of the primary igniter is used to detonate the power charge, which is typically located downhole from the primary igniter in a chamber connected to the firing head via a cartridge seat. The downhole setting tool may include a secondary igniter that is used to detonate the power charge upon the actuation of the primary igniter. The primary igniter often comprises black powder (e.g., gun powder, a mixture of sulfur, charcoal, and saltpeter) that is ignited from the electrical signal.

It has been recognized that it would be beneficial to increase the reliability with which the power charge of downhole setting tools detonates and sets the downhole device. For example, on Jan. 13, 2017, Applicant filed U.S. patent application Ser. No. 15/406,040 entitled "SETTING TOOL POWER CHARGE INITIATION" that is directed to devices and methods for initiating or setting off a power charge and on Jul. 12, 2017, Applicant filed U.S. patent application Ser. No. 15/648,009 entitled "RETAINING AND POSITIONING END CAP FOR DOWNHOLE SETTING TOOL POWER CHARGES," both of which are incorporated by reference herein in its entirety.

FIG. 4 shows an embodiment of known conventional downhole setting tool 200. The setting tool 200 may be the E-4 packer setting device which is available commercially from Baker Hughes Incorporated of Houston, Tex. The setting tool 200 includes a firing head 210 connected to an adapter 230, which is also referred to as a cartridge seat. The adapter 230 houses the primary igniter 220. The E-4 packer setting device also includes a secondary igniter 235 housed within the adapter 230, which is ignited by the actuation or ignition of the primary igniter 220. The actuation of the primary igniter 220 pushes the secondary igniter 235 towards the power charge 250 as shown by secondary igniter 235' shown in dash.

The power charge 250 includes an outer housing 255 and is positioned within a chamber 245 of a housing 240 connected to the firing head 210. The downhole side of the housing 240 is connected to a sub 280 that is connected to the device (not shown) to be set within the wellbore. The sub 280 provides communication with a mechanism, such as a piston, configured to move and set the device upon the detonation of the power charge 250 as would be appreciated by one of ordinary skill in the art. The downhole end 252 of the power charge 250 is inserted into the cavity 245 of the housing 240 and the power charge 250 is pushed into the cavity 245 until the downhole end 252 is positioned within the sub 280. The housing 240 containing the power charge 250 is then connected to the firing head 210 and the adapter 230. The uphole end 251 of the power charge 250 includes an igniter 260 that helps to detonate the power charge 250 upon the ignition of the primary igniter 220 and the secondary igniter 235. However, the igniter 260 relies on the ignition of the primary igniter 220 and the secondary igniter 235. As used herein, the uphole end refers to the end of an object that is closer to the opening of a wellbore at the surface in comparison to the other end of the object, referred to herein as the downhole end.

Conventional downhole setting tools that include power charges are very reliable and are used to set a large number of devices in a wellbore. However, even if conventional setting tools are 99% reliable, the removal of one setting tool and device out of one hundred from the wellbore is a potentially costly and time consuming operation. On occasion, the primary igniter 220 and the secondary igniter 235 fail to ignite the igniter 260 positioned within the power charge 250, thus failing to set off the power charge 250. On occasion, the igniter 260 is ignited by the primary igniter 220 and/or the secondary igniter 235, but the igniter 260 fails to cause the detonation of the power charge 250, thus failing to set a desired tool. Other disadvantages may exist.

SUMMARY

The present disclosure is directed to an igniter and ignition device for a power charge for downhole setting tools and methods of use that overcome some of the problems and disadvantages discussed above.

An embodiment of the disclosure is a downhole setting tool comprising a first housing, a second housing connected to the first housing, the second housing having a chamber, a power charge positioned within the chamber, an igniter connected to a portion of the power charge, and an ignition device connected to the igniter. The ignition device is configured to actuate upon receipt of an electrical signal.

The igniter may be connected to an uphole end of the power charge. The downhole setting tool may include an adapter positioned between the first housing and the second housing, the adapter being positioned adjacent to the uphole portion of the power charge. The igniter may be embedded into the power charge. The ignition device may be positioned within a recess in the igniter. The ignition device may be a thermal match or a heater cartridge. The ignition device may be an electric trigger that causes a chemical reaction in the power charge by the application of a voltage or a current. The igniter may comprise thermite, a metal and an oxidizer, such as, but not limited to, aluminum and iron oxide, aluminum and copper oxide, aluminum and titanium oxide, magnesium and titanium oxide, aluminum and silicon dioxide, magnesium and titanium oxide, aluminum and vanadium oxide, combinations thereof, or the like.

An embodiment of the disclosure is a method of using a downhole setting tool comprising attaching an igniter to an uphole end of a power charge configured to be selectively detonated to set a device within a wellbore. The method comprises attaching an ignition device to the igniter. The ignition device being configured to selectively ignite the igniter upon receipt of an electrical signal via an electrical conduit.

The method may comprise running the downhole setting tool into the wellbore. The method may include detonating the power charge to set the device in the wellbore. The igniter may be embedded into the power charge. The ignition device may be positioned within a cavity in the igniter.

An embodiment of the disclosure is a power charge for a downhole setting tool comprising a power charge configured to be detonated to set a tool within a wellbore, the power charge having an uphole end and a downhole end when installed within the downhole setting tool, the power charge including an outer housing. The power charge comprises an igniter connected to the uphole end of the power charge, the igniter configured to cause the detonation of the power charge upon ignition of the igniter and an ignition device connected to the igniter, the ignition device configured to selectively ignite the igniter upon receipt of an electrical signal.

The igniter may be embedded within the power charge and the ignition device may be positioned within a cavity in the igniter. The ignition device may be an electric trigger, a heater cartridge, an electric match, or a combination thereof. The igniter may comprise thermite, a metal and an oxidizer, such as, but not limited to, aluminum and iron oxide, aluminum and copper oxide, aluminum and titanium oxide, magnesium and titanium oxide, aluminum and silicon dioxide, magnesium and titanium oxide, aluminum and vanadium oxide, combinations thereof, or the like.

Figure 1:
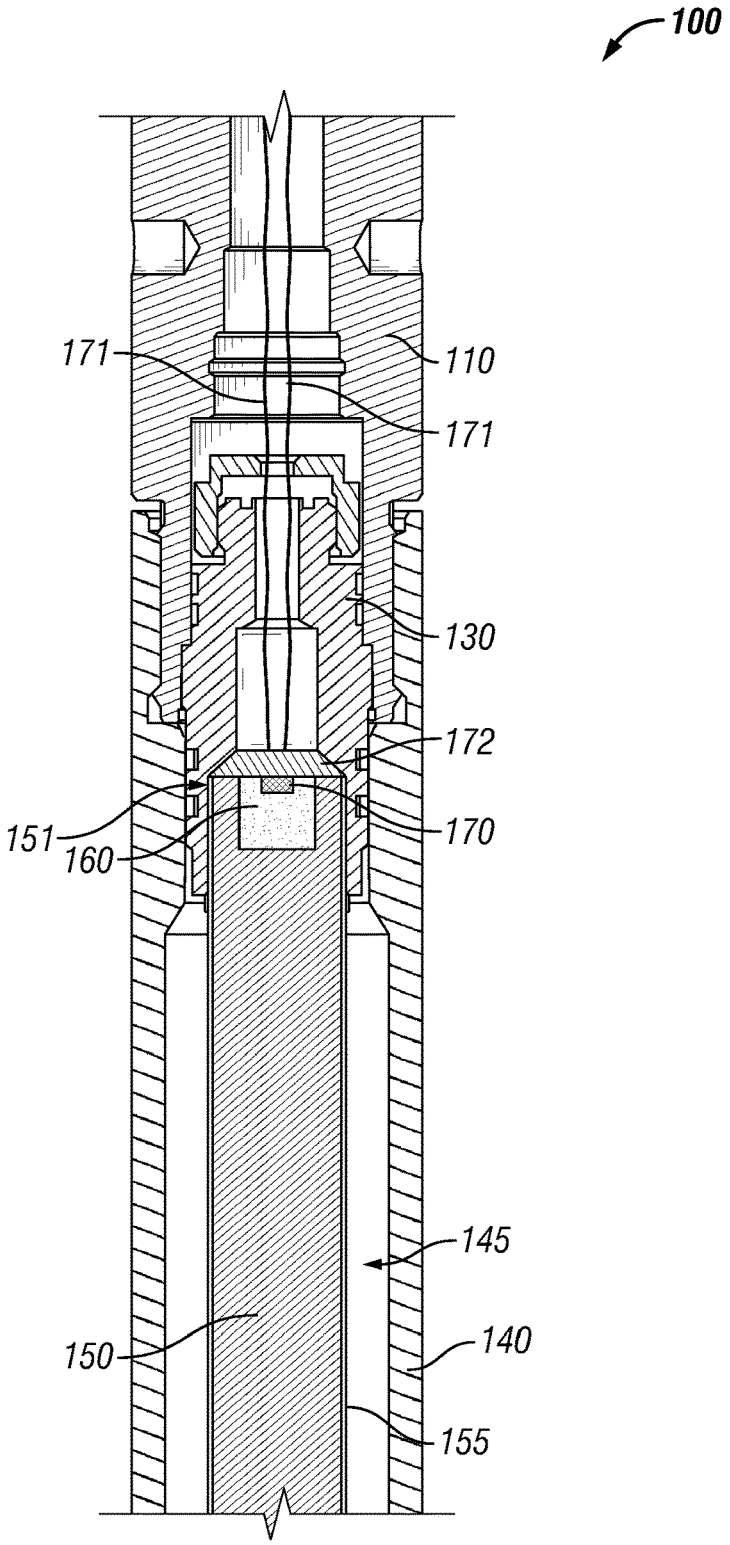
FIG. 1 shows an embodiment of a downhole setting tool that includes a power charge.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows an embodiment of a setting tool 100 that includes a power charge 150. The detonation of the power charge 150 is used to set a downhole device, such as a bridge plug or packer, in a wellbore as would be appreciated by one of ordinary skill in the art having the benefit of this disclosure. The setting tool 100 includes a first housing 110, which may be referred to as a firing head, and an adapter or sub 130 positioned between the first housing 110 to a second housing 140. Alternatively, the first and second housing 110, 140 may be configured to connect together and retain the power charge 150 without an adapter or sub 130 as would be appreciated by one of ordinary skill in the art having the benefit of this disclosure.

A power charge 150 is positioned within a chamber 145 within the second housing 140. The power charge 150 includes an uphole end 151, a downhole end 152 (shown in FIG. 2), and an outer housing 155. The downhole end (not shown) of the second housing 140 is configured to be connected to a downhole device to be set by the detonation of the power charge 150 as would be appreciated by one of ordinary skill in the art having the benefit of this disclosure. For example, a connecting sub may be connected to the downhole end of the second housing 140 to connect the chamber 145 to a mechanism, such as a piston, that sets the device upon the detonation of the power charge 150. The power charge 150 includes an igniter 160 in the uphole end 151 of the power charge 150 to detonate the power charge 150. The power charge 150 also includes an ignition device 170 that is positioned adjacent to the igniter 160. The ignition device 170 may be selectively actuated via a signal communication along communication lines or wires 171. The lines or wires 171 may pass through an ignition device adapter 172, which may help to direct the force from the detonation of the power charge 150 downwards to actuate the setting tool as discussed herein. The shape, size, and/or configuration of the ignition device adapter 172 is shown for illustrative purposes only and may be varied as would be appreciated by one of ordinary skill in the art having the benefit of this disclosure.

The actuation of the ignition device 170 causes the ignition of the igniter 160 and, thus, the detonation of the power charge 150, as discussed herein. The actuation of the ignition device 170 may be accomplished by providing voltage or current to the igniter 160 to cause the ignition of the igniter 160. Alternatively, the actuation of the ignition device 170 may be rapidly applying heat to the igniter 160 to cause the ignition of the igniter 160.

The igniter 160 is configured to cause the detonation of the power charge 150 upon ignition of the igniter 160. The igniter 160 may be comprised of various materials as would be appreciated by one of ordinary skill in the art having the benefit of this disclosure. The igniter 160 may be embedded in the power charge 150, positioned in a cavity or recess in the power charge 150, positioned adjacent to the power charge 150, or attached to a portion of the power charge 150. The igniter 160 may comprise a react on-demand material. A chemical reaction in the react on-demand material may release high energy heat upon receipt of an electrical triggering signal from the electrical ignition device 170. Examples of react on-demand materials that may be actuated upon an application of an electric voltage or current are, but not limited to, a metal and an oxidizer, such as, aluminum and iron oxide, aluminum and copper oxide, aluminum and titanium oxide, magnesium and titanium oxide, aluminum and silicon dioxide, magnesium and titanium oxide, aluminum and vanadium oxide, combinations thereof, or the like. The igniter 160 may be configured so that the high energy heat from the chemical reaction is sufficient to cause the detonation of the power charge 150. The reaction time, heat released, and/or voltage or current needed to cause the actuation of the igniter 160 may be varied depending on the application as would be appreciated by one of ordinary skill in the art having the benefit of this disclosure.

In one embodiment, the igniter 160 may be comprised of a pyrotechnic material, such as thermite. In one embodiment, a pellet of thermite may be embedded into the power charge 150. The igniter 160 may be positioned adjacent to and/or may be attached to the power charge 150. The igniter 160 may be positioned within a recess or cavity within the power charge 150. Various mechanisms may be used to attach the igniter 160 to the power charge 150 as would be appreciated by one of ordinary skill in the art having the benefit of this disclosure. For example, an adhesive material may attach or bond the igniter 160 to the power charge 150.

The igniter 160 may include a recess, opening, or cavity configured to receive the electric ignition device 170. Alternatively, the electric ignition device 170 may be positioned adjacent to and/or attached to the igniter 160. The electric ignition device 170 is configured to ignite or be actuated upon receipt of a signal. For example, an electrical signal may be transmitted to the electric ignition device 170 via lines or wires 171. Upon receipt of a signal along line 171, the electric ignition device 170 may ignite cause the ignition of the igniter 160, which in turn causes the detonation of the power charge 150. The detonation of the power charge 150 may be used to set a downhole tool as would be appreciated by one of ordinary skill in the art having the benefit of this disclosure. Receipt of a signal causes the electric ignition device 170 to be actuated, which in turn causes the ignition of igniter 160. For example, the electric ignition device 170 may rapidly heat upon receipt of a signal, which in turn causes the ignition of the igniter 160. The electric ignition device may be, but is not limited to, a thermal match, a heater cartridge, an electrical trigger, or a combination thereof.

Figure 2:
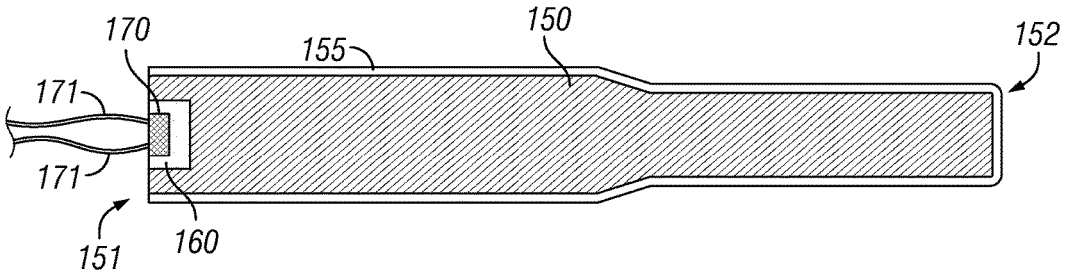
FIG. 2 shows a cross-section view of an embodiment of a power charge.

FIG. 2 shows a cross-section view of an embodiment of a power charge 150 having an uphole end 151 and a downhole end 152 that may be used to in a downhole setting tool. The power charge 150 may include an outer casing or housing 155. An igniter 160 may be embedded into the uphole end 151 of the power charge. As discussed herein, the igniter 160 may be positioned within a recess or cavity within the power charge 150, may be positioned adjacent to the power charge 150, and/or may be attached to the power charge 150 as would be appreciated by one of ordinary skill in the art having the benefit of this disclosure.

Figure 4:
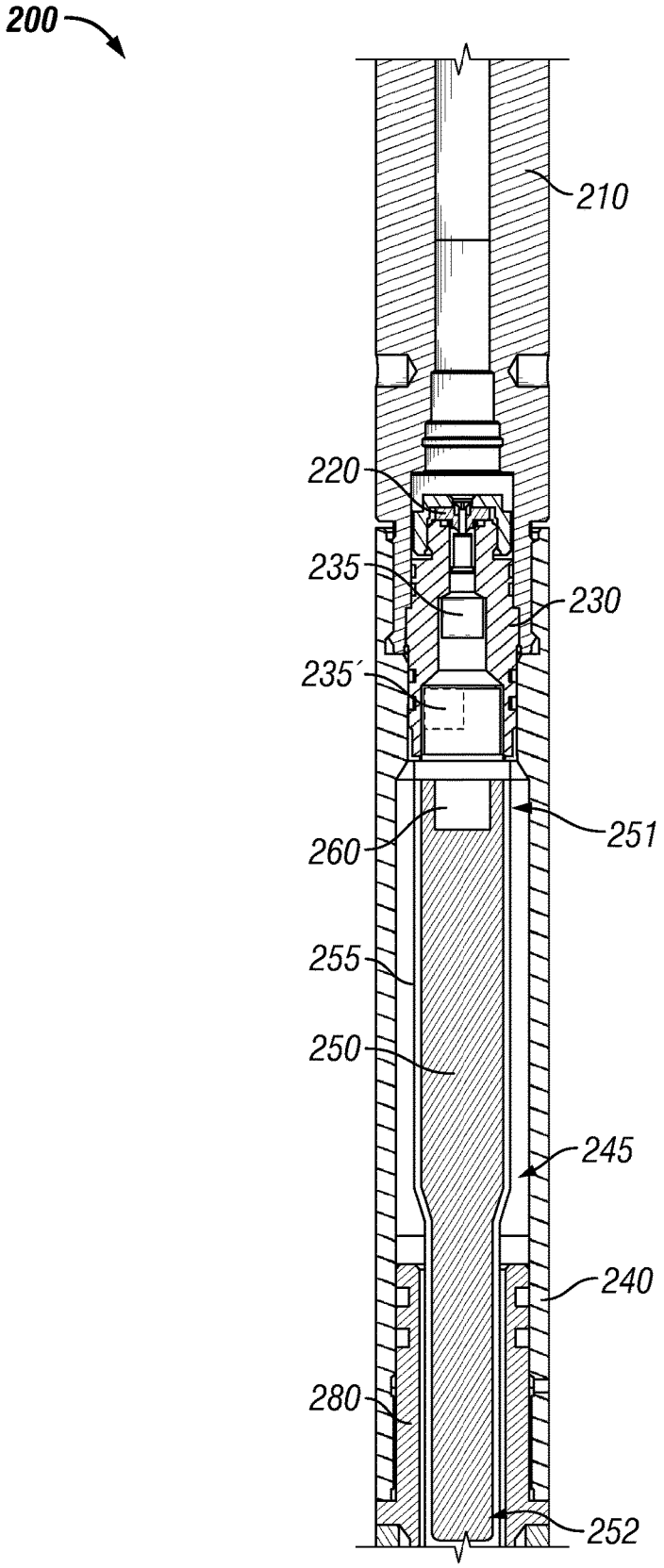
FIG. 4 (Prior Art)
FIG. 4 shows a prior art downhole setting tool that includes a power charge.

An ignition device 170 may positioned within the igniter 160. As discussed above, the ignition device 170 may be, but is not limited to, a thermal match, a heater cartridge, an electrical trigger, or a combination thereof that may be actuated upon receipt of a signal transmitted to the ignition device 170 via a communication line or wire 171. The power charge 150 is shown without an ignition device adapter 172 (shown in FIG. 1) for clarity. The igniter 160 may include a cavity or recess configured for receiving the ignition device 170. Alternatively, the ignition device 170 may be attached to or positioned adjacent to the igniter 160 as would be appreciated by one of ordinary skill in the art having the benefit of this disclosure. The positioning of the ignition device 170 adjacent to the igniter 160 of the power charge 150 may increase reliability of detonation of the power charge 150 as compared to a traditional primary igniter 220 that is positioned a distance away from the power charge 250, as shown in FIG. 4.

Figure 3:
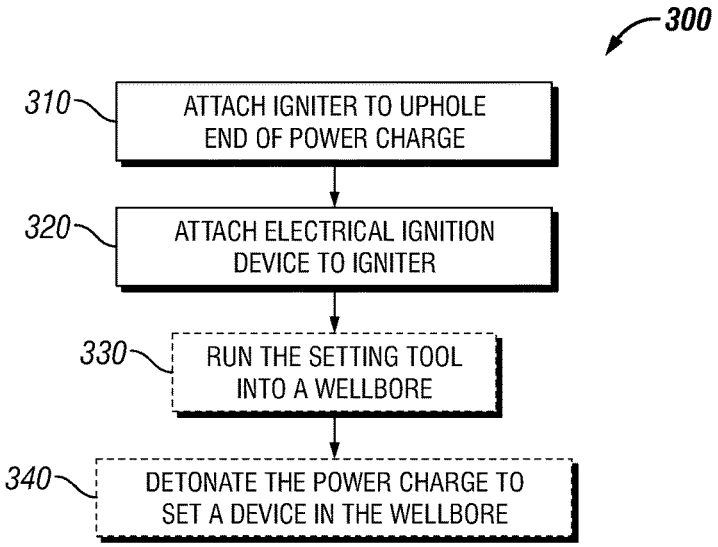
FIG. 3 shows a flow chart of an embodiment of a method of using a downhole setting tool.

FIG. 3 is a flow chart of an embodiment of a method 300 of using a downhole setting tool. The method 300 includes attaching an igniter to an uphole end of a power charge, at step 310. The igniter is configured to cause the detonation of the power charge upon ignition of the igniter. Various igniters may be used to cause the detonation of the power charge upon ignition of the igniter as would be appreciated by one of ordinary skill in the art having the benefit of this disclosure. For example, the igniter may be, but is not limited to, a pyrotechnic material, release on-demand material, or a combination thereof. The method 300 includes attaching an electrical ignition device to the igniter, at step 320. The electrical ignition device may be various devices configured to actuate or ignite by an electrical signal as would be appreciated by one of ordinary skill in the art having the benefit of this disclosure. For example, the electrical ignition device may be, but is not limitation to, a heater cartridge, an electric trigger device, an electric match, or a combination thereof. The actuation of the electrical ignition device is configured to ignite the igniter attached to the uphole portion of the power charge as would be appreciated by one of ordinary skill in the art having the benefit of this disclosure.

The method 300 may include running the setting tool into a wellbore, at step 330. The setting tool may be run to a desired location within a wellbore at which it is desired to set a device within the wellbore. The method may also include detonating the power charge to set the device in the wellbore, as step 340, with an electrical signal communicated to the electrical ignition device via an electrical line or wire. The use of an electrical signal to an electrical ignition device connect to an igniter attached to or embedded within the power charge may provide for selective and reliable detonation of a power charge within a downhole setting tool.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A downhole setting tool comprising:

a first housing;

a second housing connected to the first housing, the second housing including a chamber;

a power charge positioned within the chamber;

an igniter connected to a portion of the power charge, the igniter positioned within the second housing;

an ignition device connected to the igniter, the ignition device configured to actuate upon receipt of an electrical signal and the ignition device being positioned within the second housing; and a piston configured to move upon detonation of the power charge to cause the downhole setting tool to be set within a wellbore.

2. The downhole setting tool of claim 1, wherein the igniter is connected to an uphole end of the power charge.

3. The downhole setting tool of claim 1, further comprising an adapter positioned between the first housing and the second housing, wherein the adapter is positioned adjacent to the uphole end of the power charge.

4. The downhole setting tool of claim 1, wherein the igniter is embedded into the power charge.

5. The downhole setting tool of claim 4, wherein the ignition device is positioned within a recess in the igniter.

6. The downhole setting tool of claim 5, wherein the ignition device is a thermal match or a heater cartridge.

7. The downhole setting tool of claim 5, wherein the ignition device is an electric trigger that causes a chemical reaction in the power charge by the application of a voltage or a current.

8. The downhole setting tool of claim 1, wherein the igniter comprises thermite or comprises both a metal and an oxidizer.

9. The downhole setting tool of claim 8, wherein the igniter comprises the metal and the oxidizer, the metal and the oxidizer further comprising aluminum and iron oxide, aluminum and copper oxide, aluminum and titanium oxide, magnesium and titanium oxide, aluminum and silicon dioxide, magnesium and titanium oxide, aluminum and vanadium oxide, or a combination thereof.

10. The downhole setting tool of claim 1, wherein the downhole setting tool is a packer, a bridge plug, or a cement retainer.

11. A method of using a downhole setting tool comprising:

attaching an igniter to an uphole end of a power charge configured to be selectively detonated to move a piston to set the downhole setting tool against a casing within a wellbore; and attaching an ignition device to the igniter, wherein the ignition device is configured to selectively ignite the igniter upon receipt of an electrical signal via an electrical conduit.

12. The method of claim 11, further comprising running the downhole setting tool into the wellbore.

13. The method of claim 12, further comprising detonating the power charge moving the piston to set the downhole setting tool against the casing in the wellbore.

14. The method of claim 11, wherein the igniter is embedded into the power charge.

15. The method of claim 14, wherein the ignition device is positioned within a cavity in the igniter.

16. The method of claim 11, wherein the downhole setting tool is a packer, a bridge plug, or a cement retainer.

17. A power charge for a downhole setting tool comprising:

a power charge configured to be detonated to move a piston to set a tool against a casing within a wellbore, the power charge having an uphole end and a downhole end when installed within a downhole setting tool, the power charge including an outer housing;

an igniter connected to the uphole end of the power charge, the igniter configured to cause the detonation of the power charge upon ignition of the igniter; and an ignition device connected to the igniter, the ignition device configured to selectively ignite the igniter upon receipt of an electrical signal, wherein the power charge, the igniter, and the ignition device are each positioned within a housing of the downhole setting tool.

18. The power charge of claim 17, wherein the igniter is embedded within the power charge.

19. The power charge of claim 18, wherein the ignition device is positioned within a cavity in the igniter.

20. The power charge of claim 19, wherein the ignition device comprises an electric trigger, a heater cartridge, an electric match, or a combination thereof.

21. The power charge of claim 20, wherein the igniter comprises thermite or comprises both a metal and an oxidizer.

22. The power charge of claim 21, wherein the igniter comprises the metal and the oxidizer, the metal and oxidizer further comprising aluminum and iron oxide, aluminum and copper oxide, aluminum and titanium oxide, magnesium and titanium oxide, aluminum and silicon dioxide, magnesium and titanium oxide, aluminum and vanadium oxide, or a combination thereof.

* * * * *